United States Patent [19]

Schramm

[11] Patent Number: 4,497,284

[45] Date of Patent: Feb. 5, 1985

[54] BARREL TYPE ENGINE WITH PLURAL TWO-CYCLE CYLINDERS AND PRESSURIZED INDUCTION

[76] Inventor: Buford J. Schramm, 1330 E. Fremont Dr., Tempe, Ariz. 85281

[21] Appl. No.: 413,239

[22] Filed: Aug. 30, 1982

[51] Int. Cl.[3] ..... F02B 75/26; F01B 13/06

[52] U.S. Cl. ..... 123/41.47; 123/58 R; 123/58 B; 123/58 BA; 123/608

[58] Field of Search ..... 123/58 R, 58 B, 58 BA, 123/41.47; 60/607, 608

[56] References Cited

U.S. PATENT DOCUMENTS

| | | | |
|---|---|---|---|
| 1,366,149 | 1/1921 | Applin | 123/41.47 |
| 1,696,676 | 12/1928 | Fuhr | 123/58 BA |
| 2,354,620 | 7/1944 | Smith | 60/607 |
| 2,710,521 | 6/1955 | Nettel | 60/607 |
| 3,078,832 | 2/1963 | Braine | 123/58 R |
| 3,654,906 | 4/1972 | Airas | 123/58 B |
| 4,090,478 | 5/1978 | Trimble et al. | 123/58 A |

*Primary Examiner*—Craig R. Feinberg
*Assistant Examiner*—David A. Okonsky
*Attorney, Agent, or Firm*—Donald D. Mon

[57] ABSTRACT

A barrel-type internal combustion engine having a plurality of parallel two stroke piston-cylinder assemblies grouped around a central axis and output shaft. The induction system is from a charge-forming means into intake ports on the outside of the cylinder array, without passage through the crank case. The exhaust ports face inwardly into a central exhaust gas collector. A rotary exhaust valve control the exhaust. Coolant is circulated from a central pump. The induction system can be pressurized by a supercharger or a turbocharger. A swash plate converts axial piston movement to rotary movement of the output shaft.

7 Claims, 12 Drawing Figures

BARREL TYPE ENGINE WITH PLURAL TWO-CYCLE CYLINDERS AND PRESSURIZED INDUCTION

FIELD OF THE INVENTION

This invention relates to a barrel type internal combustion engine which has a plurality of axially-oriented two-cycle engine elements and utilizes a pressurized induction system, for example a turbocharged or supercharged induction system.

BACKGROUND OF THE INVENTION

Conventional objectives in the design of internal combustion engines, especially those for use in aircraft, are to increase the horsepower-to-weight ratio, reduce wear and vibration, reduce the number of engine parts, reduce the cost of the engine, and make the engine more producible, requiring as little capital expense as possible to tool and mass produce the necessary parts. This is a very large order indeed, and the substantial number of engines of different types which have been designed and built testifies to the complexity of the problems.

The relatively small number of manufacturers of larger engines reflects the large capital costs inherent in building a conventional engine. For example, the manufacture of crankshafts and rods requires costly dedicated machinery equipment, well beyond the resources of small companies. If a smaller company does build a substantial engine which uses standard crankshafts and rods, it must buy these parts outside and contend with long lead times, inflexible production schedules, and excessive inventory costs. Furthermore, there still may remain the problems of grinding, milling, and balancing. A solution, of course, is to design an engine without a conventional crankshaft or conventional rods.

By means of this invention, the crankshaft may be replaced by a swash plate which directly converts the reciprocation of pistons to rotation of an output shaft, by means of connecting rods which can have simple clevis-type attachments at both ends. By so doing, a simple forged rod is enabled to be used which does not require the extensive grinding and honing that conventional rods require, especially when one end must be split to be installed on a crankshaft throw bearing.

A 200 horsepower engine according to this invention requires only about 60 hours of machining and assembly time, compared to about 175 hours to build a comparable four-cycle engine, using the "tool room" method of manufacture.

However, an engine according to this invention is not merely more producible for less cost and with less capital invested. In addition it enables a group of two-cycle engine elements to be linked to a pressurized induction system that is independent of the crankcase, and which can utilize turbochargers or superchargers without needing conventional combustors, and without the expensive and sensitive fuel controls that are used in conventional pressurized turbine engine systems. In this invention, the two-cycle engine elements function as the combustor, and simple carburetion techniques suffice for the fuel control. Furthermore, the engine is easily started with the use of starter motors which are light enough that they do not constitute a serious weight disadvantage even in an air-borne unit.

Especially for engines to be used in aircraft, the cross-section facing the oncoming airstream should be minimized. This engine is quite compact, with high-density placement of its components.

Conventional two-cycle engines generally require an over-square relationship between the diameter of the cylinder and the length of the piston stroke—the stroke length being shorter than the diameter of the cylinder. As a consequence, such engines generally run at higher RPMs, for example between about 6,000–8,000 RPM. This results in a very high piston surface foot per minute rate, with consequential accelerated wear and loss of energy to friction. The instant engine is able to be built under-square, with a stroke which is longer than the bore diameter, and still maintain efficient power. Therefore it can operate at a slower speed—about 4,500 RPM at a considerable saving in wear and in friction losses. By way of comparison, a conventional engine consumes about 25% of its developed energy in overcoming internal friction. In the instant engine, this loss is closer to 10%.

In addition to the foregoing advantages, this engine utilizes an improved central exhaust valve linked directly to the output shaft. A simple central exhaust gas collector, and a simplified single induction manifold are also used. These reduce the cost of the engine. No longer need the engine be surrounded by hot pipes which are subject to cracking and radiate heat which heats incoming fuel charges.

Also, cooling of the engine is radically simplified by a central porting and distribution system. It is especially efficient in its cooling of the engine at the cylinder exhaust ports. Even further, the induction system can be disposed around the outside of the engine where it can be kept cool. As a consequence of the foregoing, an efficient engine is provided which can economically be produced, and whose performance more readily relates to a turbine engine than to a reciprocating-type engine. It may properly be regarded as the "Poor Man's Turbine," and constitutes an important stride in freeing the small manufacturer from the serious economic limitations that are inherent in the manufacture of conventional reciprocating engines.

BRIEF DESCRIPTION OF THE INVENTION

This invention comprises a barrel-type engine with a plurality of two-cycle engine elements arranged parallel to one another around and parallel to an engine axis. An output shaft rotates on the engine axis, and is linked to the pistons through a tilted swash plate. Connecting rods are journaled to the swash plate and to respective pistons so that the thrust of the pistons tends to tilt the plate which, because of its construction and mounting, rotates the output shaft.

According to a feature of the invention, the exhaust ports of the cylinders discharge into a common central receiver for discharge from the engine. A rotary valve connected to the output shaft exerts a sequential valving function on the exhaust ports.

According to yet another feature of the invention, coolant is distributed into the engine from a central region, from which it simultaneously flows to all of the cylinders, preferably first cooling the exhaust ports, and preferably also passing through a passage in a web disposed in the path of the exhaust gases at the exhaust ports.

According to yet another feature of the invention, pressurizing means supplies air under pressure to the induction system. Such means may, for example, be a turbocharger or a supercharger.

According to still yet another feature of the invention, the induction system surrounds the cylinders and feeds them through ports that are well away from the exhaust system.

The above and other features of this invention will be fully understood from the following detailed description and the accompanying drawings, in which:

DETAILED DESCRIPTION OF THE INVENTION

Figure 3:
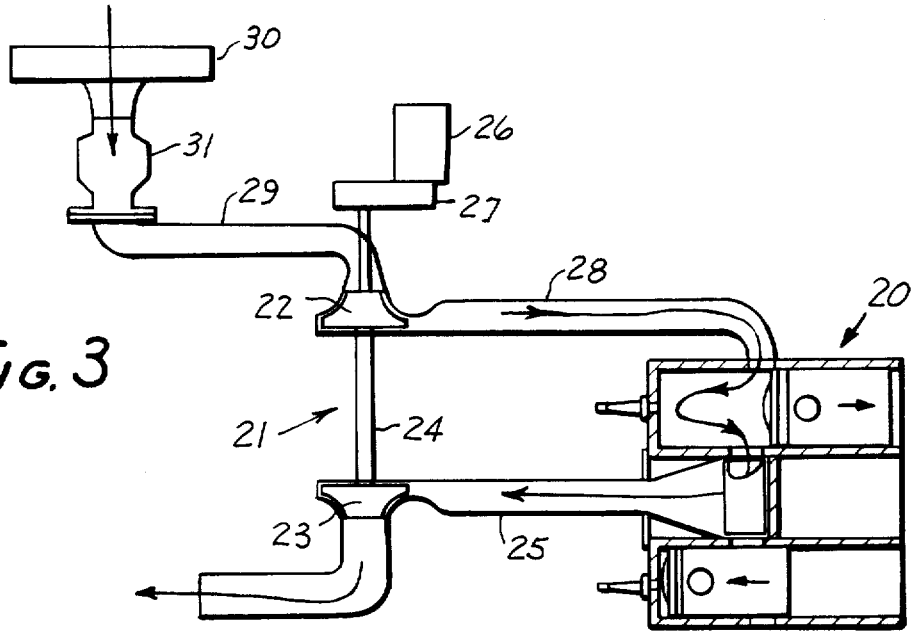
FIG. 3 is a schematic that shows the pressurization system which includes the engine of FIG. 1.

The presently preferred system of this invention is schematically shown in FIG. 3. Engine 20, yet to be described, is coupled to a turbocharger 21. The turbocharger includes a compressor wheel 22 and a turbine wheel 23, both fixed to a shaft 24. Exhaust gases from exhaust conduit 25 drive the compressor wheel, which through the shaft drives the turbine wheel. A small starter spin-up motor 26 is connected to shaft 24 through a gear drive 27 that can be disconnected after the starting operation is finished. The compressor wheel discharges its pressurized fluid to an induction conduit 28. In turn, air to be pressurized is supplied to the turbine wheel through induction pipe 29 that receives air from atmosphere through a filter 30. A conventional carburetor 31 is placed in the air flow where it will add the proper amount of fuel to the air and thereby form a charge. If preferred, fuel injection techniques may be used, or even direct diesel-type injection of fuel directly into the engine cylinder. The pressurizing objective is principally that of supplying air for the charge under pressure to the engine.

Instead of a turbocharger as shown, a conventional gear-driven supercharger may instead be used. However, the efficiencies of the turbocharger and its ready and economical availability on today's market strongly urge that a turbocharger be used to pressurize the system.

Figure 1:
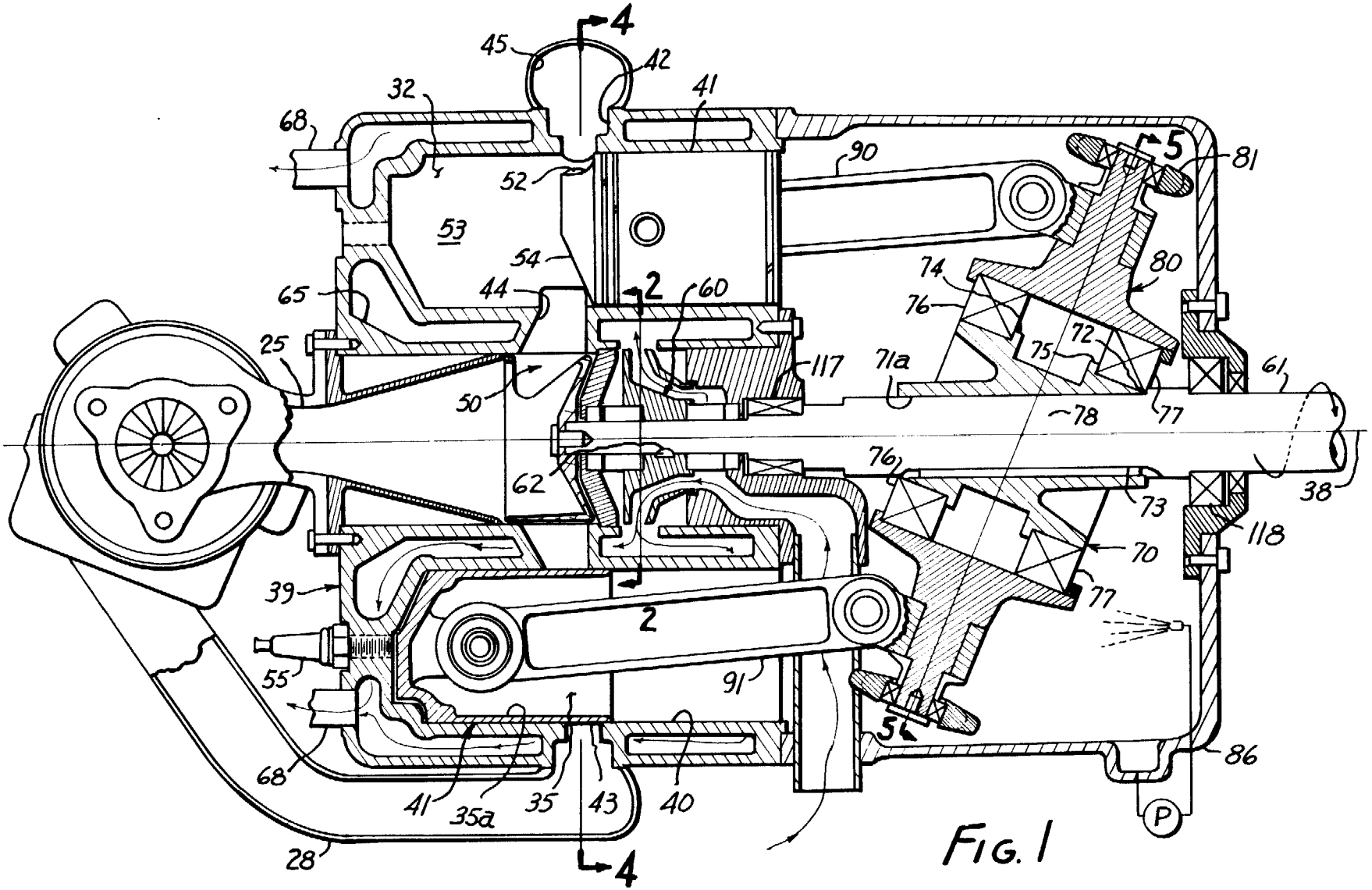
FIG. 1 is an axial view, principally in axial cross-section, showing the presently preferred embodiment of the invention.
Figure 4:
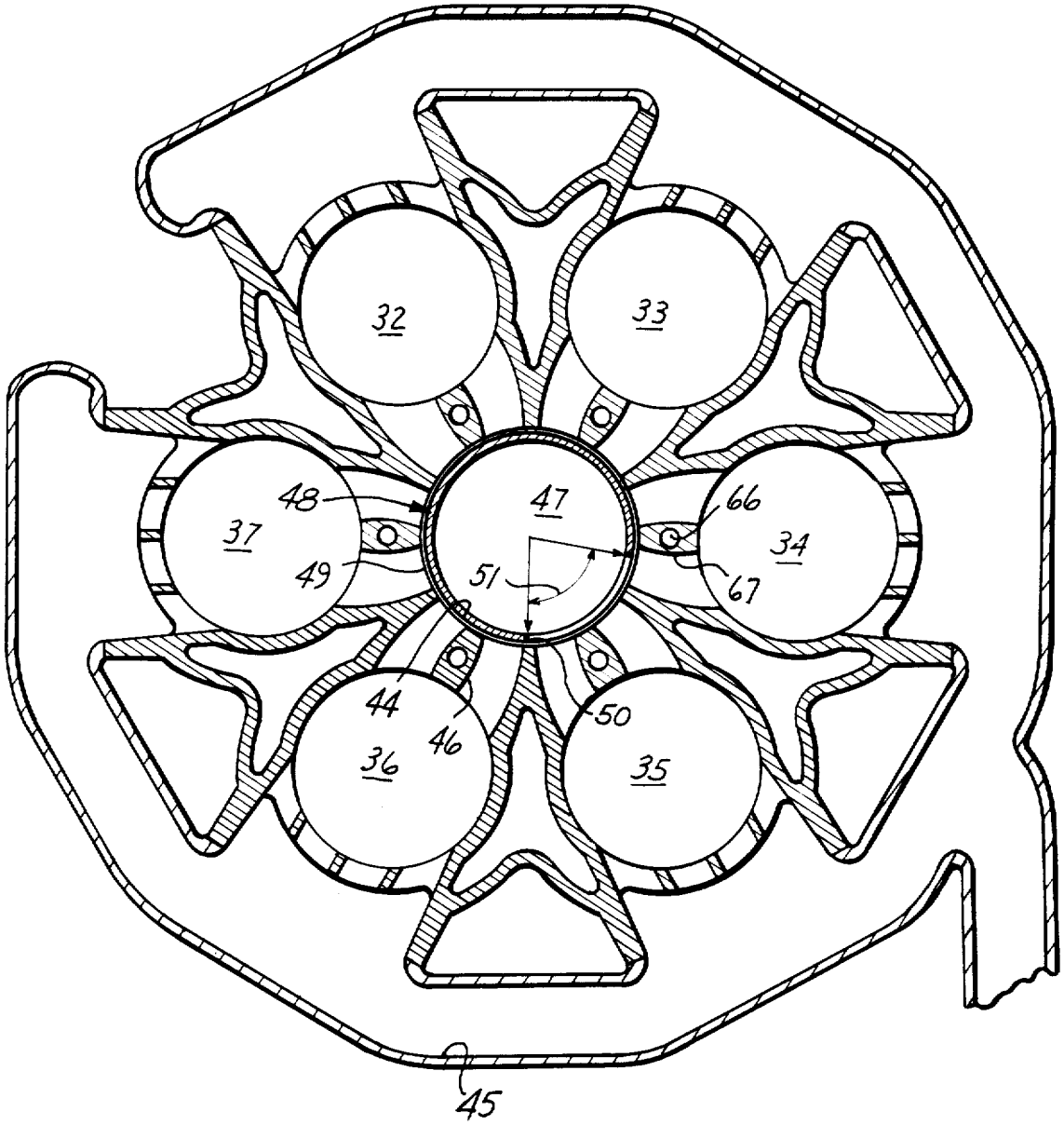
FIGS. 4 and 5 are cross-sections taken at lines 4—4 and 5—5, respectively, in FIG. 1.

Engine 20 is shown in detail in FIGS. 1, 2, 4, and 5. As best shown in FIGS. 1 and 4, the engine comprises six two-cycle engine elements 32-37. They are grouped around an engine axis 38 in a symmetrical pattern. They are parallel to one another, and are parallel to the engine axis. They form part of an engine block 39, and may be supplied with appropriate sleeves or other conventional engine features as desired. More or fewer than six engine elements may be used as desired, but six engine elements appear to provide all of the advantages of the engine without the further complexity or enlargement in size that would accompany the use of more of them.

Because the engine elements are all identical, a description of one set of parts will suffice. A cylinder 40 includes a bore in which there is fitted a piston 41 for reciprocation along the cylinder axis. As is customary in two-cycle engines, there is an intake port 42 whose valving is accomplished by the skirt 43 of the piston. Similarly, there is an exhaust port 44 through the wall of the cylinder whose valving is in this engine partly accomplished by the skirt of the piston.

The intake ports are grouped around the outside of the engine and are individually connected to an intake manifold 45 that receives pressurized air or pressurized charge from induction conduit 28. It will be observed that there is no transfer passage or transfer port in the engine elements, for the reason that the crankcase is not involved in the fuel induction system. The fuel induction system is confined entirely to the intake manifold, cylinders, and to the exhaust collector. They all face outwardly, and their manifold is cooled by surrounding air.

The exhaust ports are all directed inwardly, as best shown in FIG. 4. Each of them is divided into a pair of openings by a central exhaust port web 46, and they all discharge into a central exhaust collector 47. Inside the exhaust collector, there is a rotary valve 48 which is keyed to an output shaft 61. Valve 48 has a cylindrical outer wall 49 with a timing port 50 therethrough. The timing port has an angular extent shown by arrow 51 (FIG. 4). It will be noted that there is a clearance between outer wall 49 and the inner wall at the exhaust ports. It is not necessary that rotary valve 48 make a tight gas seal, only that it be reasonably close, and that it not rub on the engine block. Timing port 50, as best shown in FIG. 1, is appropriately shaped so as most effectively to time the cut-off of exhaust gas through the exhaust ports. All exhaust is inside the grouped cylinders, and the outer induction system is shielded from its heat by the intervening cylinders. The exhaust conduitry is reduced to a minimum in this engine, because it is centrally located.

Each piston has a surface 54 which faces into chamber 53. A deflector 52 faces the inlet port to guide the gases into and out of the combustion chamber. A conventional ignition plug 55 is threaded into the block to provide a spark to the combustion chamber.

Figure 2:
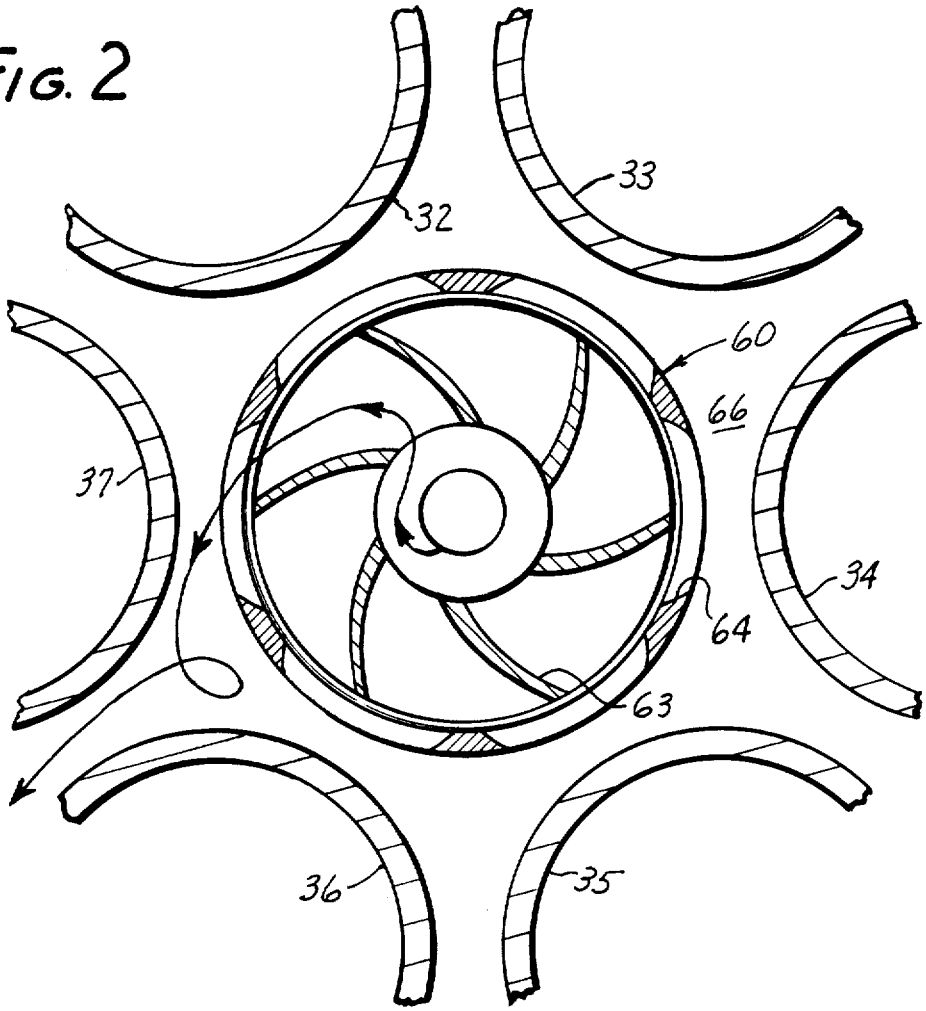
FIG. 2 is a fragmentary cross-section taken at line 2—2 in FIG. 1.

A centrifugal coolant pump 60 is mounted to output shaft 61 and rotationally coupled to it by a key 62. As best shown in FIG. 2, this pump includes vanes 63 that propel coolant through pump ports 64 to coolant passages 65. The coolant passages pass through a jacket surrounding the combustion chamber and also near the foot of the cylinder. Importantly, coolant is driven toward all engine elements simultaneously, and its first flow while it is the coolest is in the regions surrounding the exhaust ports. These regions are the most critical in two-cycle engines, because that is where the engine is the hottest.

In addition, as best shown in FIG. 4, smaller coolant passages 66 are formed in webs 67 that are placed in the intake ports. These webs are provided for support purposes for the piston rings. Also, they are subject the the worst wear and abuse because of the high temperatures to which they are exposed. Thus this coolant system first cools the areas surrounding the exhaust ports and also the webs inside them, and then the wall of the cylinders. After it has concluded its cooling flow, the coolant is exhausted through coolant outlet 68, where it passes through a radiator (not shown) and later is recirculated.

Conversion of the reciprocating movement of the pistons to rotational movement of output shaft 61 is accomplished by means of connecting rods and a swash plate now to be described.

A swash plate mount 70 has a peripheral inner race 71. The mount has a central aperture 71*a* disposed at an oblique angle to the plane of the inner race. The shaft passes through the central aperture. The shaft has a shoulder 72 against which the mount abuts, and the inner race is thereby located relative to the shaft. A key 73 in a keyway in the output shaft and in the mount couple them for simultaneous rotation. Means (not shown) holds the mount against shoulder 72. Two flanges 74, 75 support bearings 76, 77 on the bearing mount whose planes of rotation are parallel to line 5—5 in FIG. 1 and form an angle 78 with the engine axis. Swash plate 80 acts as an outer race, and is mounted to the outer races of these bearings so that the bearing mount and the output shaft are rotatable relative to the swash plate. It will be seen that rotation of the output shaft will rotate the swash plate mount, and that the plane of rotation of the bearings will progressively turn around the engine axis.

Figure 5:
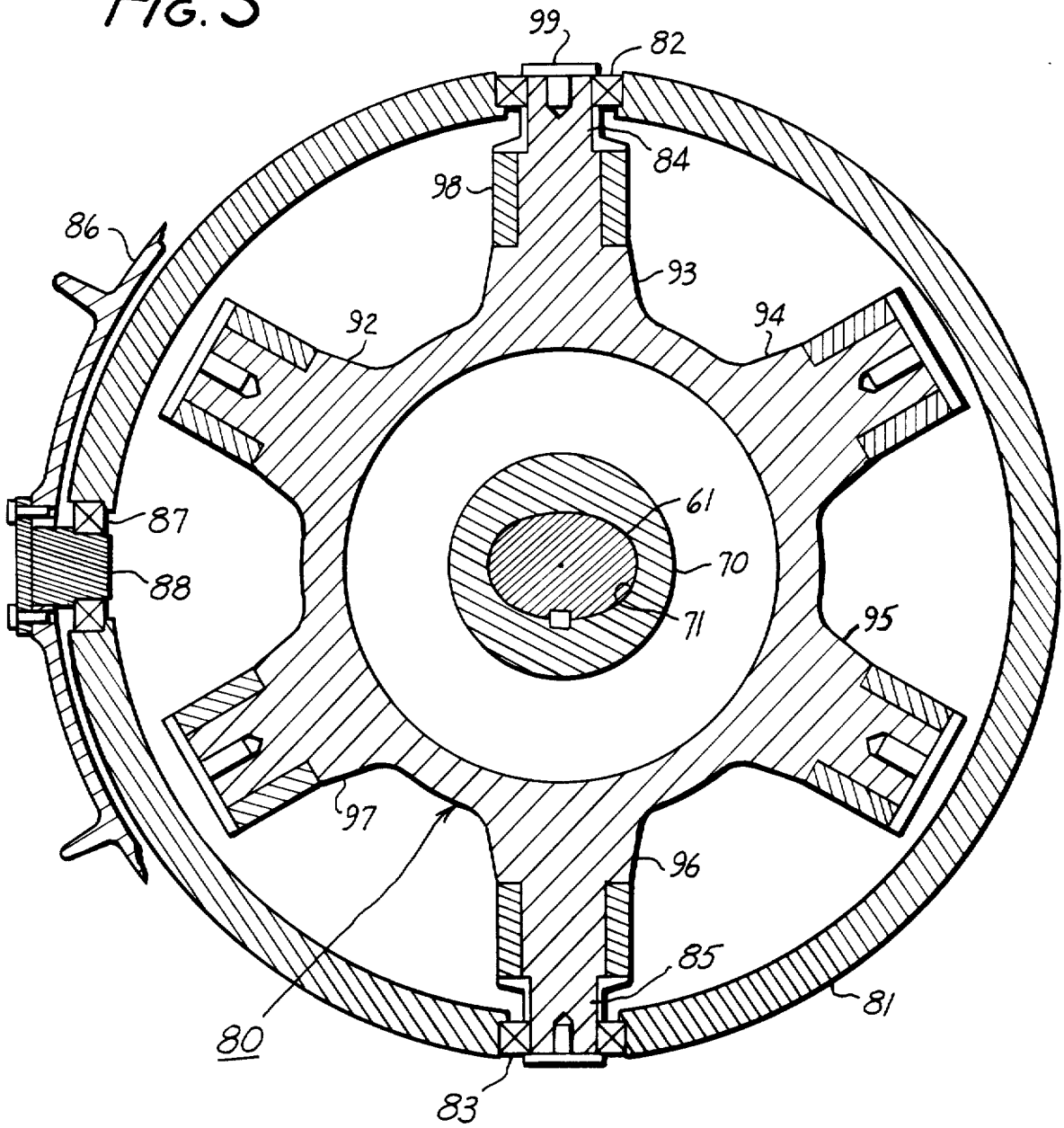
Figure 6:
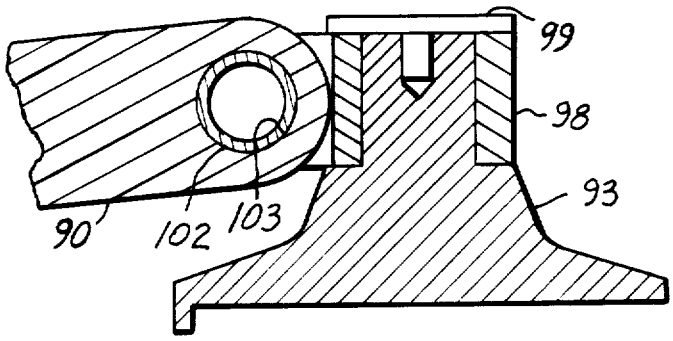
FIG. 6 is a fragmentary cross-section of one embodiment of a part of the engine shown in FIG. 1, taken at line 6—6 in FIG. 7.
Figure 7:
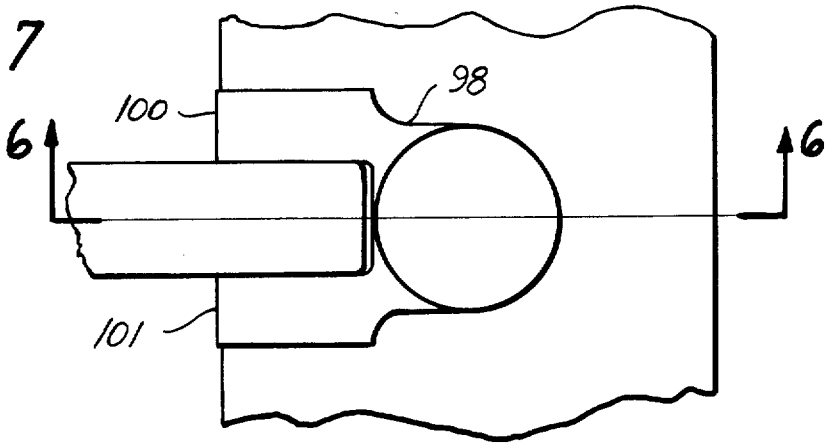
FIG. 7 is a top view of the part of FIG. 6.

The swash plate itself does not rotate relative to the engine, but it does engage in the same kind of tilting progression that the said plane of the bearings undergoes. As best shown in FIG. 5, the swash plate is first mounted to a gimbal ring 81 by a pair of ring-to-plate bearings 82, 83. These bearings are mounted to respective necks 84, and 85 on the swash plate, which are in line on a diameter of the swash plate. Thus there is a rotational degree of freedom around the axes of bearings 82 and 83. The gimbal ring in turn is mounted at a single point on block extension 86 by means of a bearing 87.

This gimbal arrangement permits the swash plate to rock around the axis of bearings 82 and 83, and permits the gimbal to rock around the axis of bearing 87. However, bearing 87 is mounted to a fixed projection 88 on the block extension which prevents rotation of the gimbal and by extension rotation of the swash plate around the engine axis. Thus, means restrains the swash plate against rotation around the engine axis, but its tilting motion is reacted to turn the crankshaft. The maximum force exerted on projection 88 in the 200 horsepower engine described herein is about 1,000 pounds. Thus, the swash plate is free to undergo its progressive movements but without rotation around the engine axis.

FIGS. 6–9 show two different means for attaching connecting rods such as rods 90 and 91 to the swash plate. The swash plate is provided with necks 92–97, one respective to each piston. The swash plate is best shown in FIG. 5. Because all are identical, only one will be described in detail. With respect to neck 93, a yoke 98 is spindled onto the neck and held there by a cap 99 threaded into the end of the neck. The yoke includes a pair of arms 100,101 which receive a cross pin 102 that passes through an aperture 103 in the end of rod 91. This enables the rod to pivot around the axis of cross pin 102.

Figure 8:
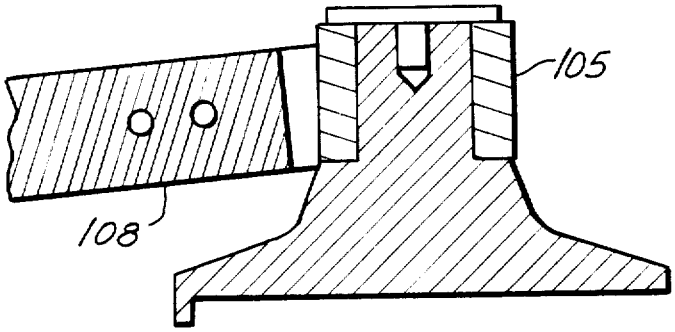
FIG. 8 is a fragmentary cross-section of another embodiment of the part of FIG. 6, taken at line 8—8 in FIG. 9.
Figure 9:
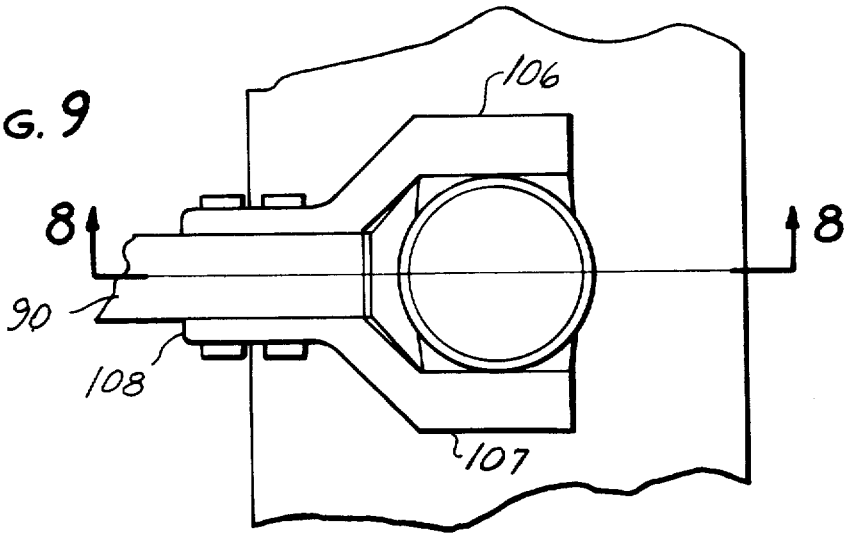
FIG. 9 is a top view of the part of FIG. 8.

In FIG. 8, a neck is shown surrounded by a hinge block 105 that is pivotally pinned to arms 106,107 of yoke 108 by a pin (not shown). In both embodiments (FIG. 8 being preferred), the rod is pivotal around an axis that is parallel to the plane of the swash plate.

While similar connections can be made between the connecting rod and the piston, there is a geometrical peculiarity of this machine that the connection as shown to the swash plate if provided at both ends, will cause four of the six connecting rods to undergo a limited amount of rotation when they are near the ends of the piston stroke. This small angular movement is sometimes called "rifling" and is very undesirable because of the additional local wear it causes to rings and to the cylinder wall. For this reason, a modified connection is provided at one end or the other of each rod, most conveniently between the connecting rod and the piston as best shown in FIG. 12.

Figure 12:
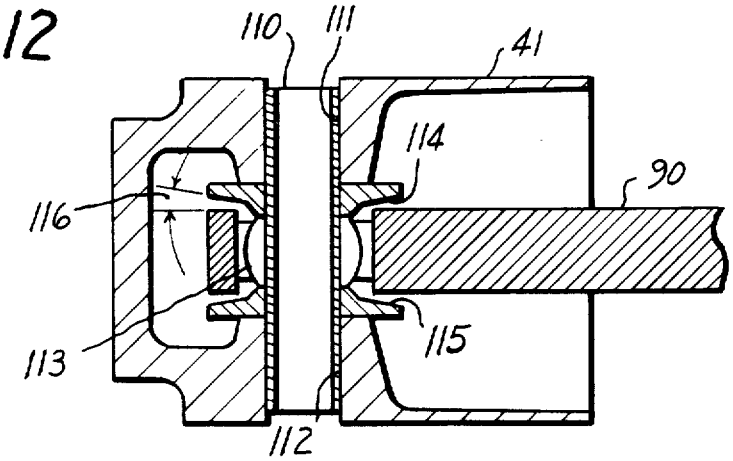
FIG. 12 is a fragmentary axial cross-section showing the preferred embodiment of connection between a connecting rod and a piston.

In FIG. 12, rod 90 is shown mounted to a piston by a cross pin 110 which is fitted in openings 111,112 that extend through the piston. A spherical-type bearing 113 is mounted to the cross pin, and abuts a pair of limit shoulders 114,115 which limit the angular excursion of the rod to angle 116 as shown, but provides sufficient freedom that once the piston is centered relative to the rod there will rarely be contact between these two surfaces. Thus, the rod can engage in both tilting and twisting movement around the spherical bearing so that it does not create rotation of the piston end, this type of mount can be placed at the swash plate end, or even at both ends if preferred. Similarly, if the rifling wear is not found to be objectionable, identical connections may be made, at both ends using the constructions of FIGS. 6–9.

Lubrication in this engine is elegently simple. In FIG. 1 there is shown an oil sump 200 from which a pump 201 withdraws oil for recirculation. It supplies oil under pressure to manifold 202, only part of which is shown, that feeds oil to nozzles 203, one for each cylinder, which spray oil to each cylinder. As a consequence, oil does not have to be added to the fuel, which is a substantial saving of oil, and leads to reduced pollutant output.

The operation of the system should be evident from the foregoing. To start it, the turbo spin-up starter motor is energized and the gear drive is engaged to drive the turbocharger. A charge is thereby injected into those cylinders whose pistons are in a position such as to leave the intake port open to entry of the charge. Next, a starter motor (not shown) is engaged to a conventional ring gear (not shown) which is connected to the drive shaft. At about this time, the exhaust port may be partially or entirely opened by the piston, but it might be closed by the rotary valve 48. The ignition plug is fired and the engine is started within a few cycles, at which time both starters are disengaged. Each of the cylinders will by then have been provided with an appropriate charge and be firing on line. It is surprising how quickly this engine does start. Rotary valve 48 is provided for the purpose of closing the outlet port before the intake port is fully closed, in order to conserve the charge.

When the charge is fired, the rod will exert a force on the swash plate, tending to tilt it away from the cylinder. This can be accomplished only if there is also rotation of the center of the mount and that is the objective of the mount, and is the manner in which it converts the movement of the rod into rotation of the output shaft (in this embodiment), even though the swash plate itself does not rotate.

The progression of firing can go in either direction as selected. When the shaft is turned, it also turns not only the rotary valve but also the centrifugal pump so as to force coolant through the system.

The system now operates principally as a turbo-type engine, with the two-cylinder engine elements behaving as a combustor in the system. Persons familiar with turbine engines will recognize the elegant simplicity of this type of combustor and its ultimate reduction in cost and complexity. Throttle control is exerted by the carburetor or other fuel control supply as desired, and does not require complicated metering or other control systems. The output shaft is journaled in the engine by journals 117,118 in the engine block and in the block extension, respectively.

From the foregoing it will be seen that this engine utilizes only conventional parts which are readily manufactured. The most expensive part is the cylinder head, but cylinder heads can be manufactured on conventional multi-spindle, numerically controlled machine tools, and do not require the high capital expense of dedicated machine tools required to manufacture connecting rods and crankshafts.

As is evident in the drawings, the engine is undersquare by a ratio of about 1.1, this being the ratio of stroke length to cylinder bore diameter.

An engine as just described, with all of its components has been built with a 225 cubic inch displacement with a theoretical output of approximately 1.5 horsepower per cubic inch. De-rated for continuous duty in aircraft, this engine can be expected to provide approximately 200 horsepower continuous duty per 200 pounds of weight. Comparable four-cycle engines at present time weigh about 350 pounds.

The simplified design of the engine has resulted in radically reducing the machining time. Standard tool room type and numerical control equipment can be used for low and medium volume production runs. Thus, this engine opens the engine manufacturing business to companies which heretofore have been excluded from it due to the substantial costs of machinery, and of the limitations and expense of inventory.

Figure 10:
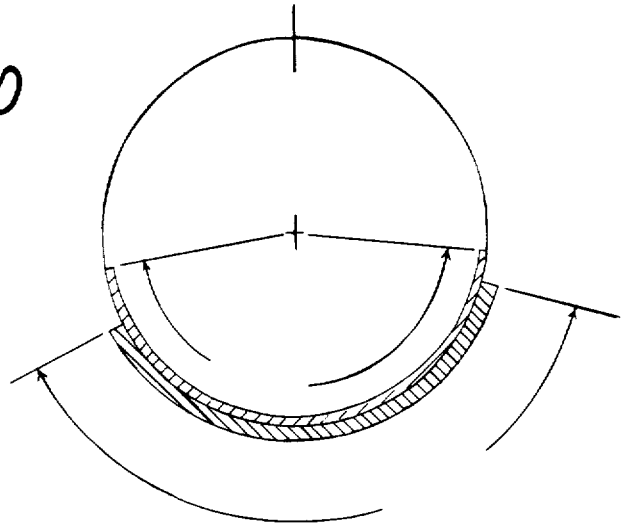
FIGS. 10 and 11 are schematic sections showing certain valving considerations in a conventional two cycle engine and in the engine of this invention, respectively.
Figure 11:
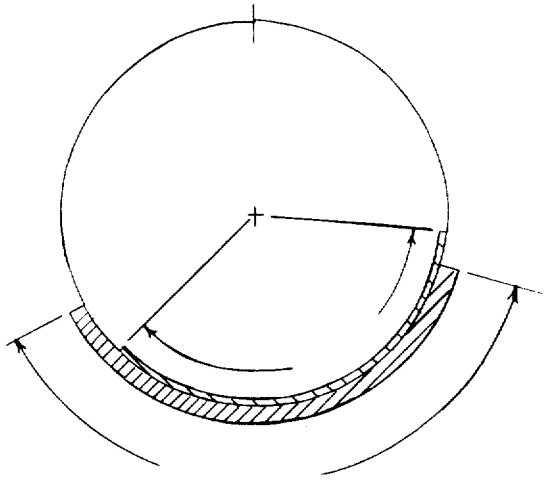

FIGS. 10 and 11 illustrate advantages of the valving of this invention. As shown in FIG. 10, which illustrates a conventional construction, the exhaust port of a conventional two-cycle engine always closes after the intake port closes. This wastes precious fuel.

However, as shown in FIG. 11, which illustrates this invention, the valued engine exhaust port timing can be optimized to provide for best fuel economy, even to the point of closing the exhaust port openings well before the intake port closes. This extreme condition is shown in FIG. 11. Thus, this engine is inherently more efficient in its use of fuel than conventional engines are.

This invention is not to be limited by the embodiments shown in the drawings and described in the description which are given by way of example and not of limitation, but only in accordance with the scope of the appended claims.

I claim:

1. In a two-cycle engine having an engine axis, an engine block, an axially-extending output shaft journaled to said block, each cylinder having a cylinder axis, and each cylinder axis being parallel to said engine axis, a piston slidably fitted in each of said cylinders for reciprocation along its respective cylinder axis, said cylinders being symmetrically centered around said engine axis, swash plate means mounted to said output shaft for rotation therewith, connecting rod means interconnecting said pistons to said swash plate means whereby reciprocation of said pistons is converted to rotation of said output shaft by said swash plate means, the improvement comprising: an exhaust port from each cylinder facing toward said engine axis and opening onto a generally circular surface, a rotary valve mounted to said output shaft and rotated therewith, said rotary valve being principally bounded by a generally circular surface, said surfaces being coaxial, and spaced from one another in close proximity, said rotary valve having a timing port therethrough adapted, when the rotary valve is turned, sequentially and alternatively to open and to occlude said outlet ports so as respectively to enable and to impede flow of exhaust gases from the cylinders; a central exhaust gas collector receiving exhaust gases passed by said rotary valve from said cylinders; each of said exhaust ports being partially occluded by an axially-extending exhaust port web which serves to support a sliding piston ring as it moves along the exhaust port, there being a coolant passage extending through said exhaust port web through which coolant flows to cool said web.

2. A two-cycle engine having an engine axis, comprising: an engine block; an axially-extending output shaft journaled to said block; a plurality of cylinders in said block, each cylinder having a cylinder axis, an axial cylinder wall, parts to be cooled, and each cylinder axis being parallel to said engine axis; a piston having a piston wall slidably fitting in each of said cylinder walls for reciprocation along its respective cylinder axis; said cylinders being symmetrically clustered around said engine axis, each said cylinder having an intake port through its wall adapted to be covered and uncovered by the wall of its respective piston, all of said intake ports facing generally outwardly away from said engine axis; an intake manifold connected to said intake ports; each said cylinder having an exhaust port through its wall adapted to be covered and uncovered by the wall of its respective piston, all of said exhaust ports facing generally inwardly and discharging into a central exhaust collector; a rotary valve in said exhaust collector coupled to said output shaft and having a timing port therethrough adapted, when rotated, sequentially and alternatively to open and to occlude said outlet ports so as respectively to enable and to impede flow of exhaust gases from the cylinders into said exhaust collector; a coolant pump coupled to said output shaft disposed on said engine axis, said engine block having coolant passages departing from said coolant pump and passing simultaneously to cool each of said outlet ports, and thereafter the said parts of the cylinder to be cooled, there being a supply and a drain conduit to said coolant pump and from said passages, respectively; a swash plate mount mounted to said engine shaft and restrained to it for rotation therewith; bearing means having a plane of rotation making an angle with said engine axis; a swash plate mounted to said bearing means and being aligned with said plane of rotation with its own plane tilted relative to said engine axis; a connecting rod respective to each piston, said rod having a pair of ends: first pivot means connecting one said end of each of said rods to said swash plate; and second pivot means connecting the other said end of each of said rods to a respective piston; each of said exhaust ports being partially occluded by an axially-extending exhaust port web which serves to support a sliding piston ring as it moves along the exhaust port, there being a coolant passage extending through said exhaust port web through which coolant flows to cool said web.

3. A two-cycle engine according to claim 2 in which the coolant which flows through the passages in the exhaust port webs has not yet been used to cool said remainder of said parts of the cylinder to be cooled.

4. A two-cycle engine having an engine axis comprising: an engine block; an axially-extending output shaft journaled to said block; a plurality of cylinders in said block, each cylinder having a cylinder axis, an axial cylinder wall, parts to be cooled, and each cylinder axis being parallel to said engine axis; a piston having a piston wall slidably fitting in each of said cylinder walls for reciprocation along its respective cylinder axis; said cylinders being symmetrically clustered around said engine axis, each said cylinder having an intake port through its wall adapted to be covered and uncovered by the wall of its respective piston, all of said intake ports facing generally outwardly away from said engine axis; an intake manifold connected to said intake ports; each said cylinder having an exhaust port through its wall adapted to be covered and uncovered by the wall of its respective piston, all of said exhaust ports facing generally inwardly and discharging into a central exhaust collector; a rotary valve in said exhaust collector coupled to said output shaft and having a timing port therethrough adapted, when rotated, sequentially and alternatively to open and to occlude said outlet ports so as respectively to enable and to impede flow of exhaust gases from the cylinders into said exhaust collector; a coolant pump coupled to said output shaft disposed on said engine axis, said engine block having coolant passages departing from said coolant pump and passing simultaneously to cool each of said outlet ports, and thereafter the said parts of the cylinder to be cooled, there being a supply and a drain conduit to said coolant pump and from said passages, respectively; a swash plate mount mounted to said engine shaft and restrained to it for rotation therewith; bearing means having a plane of rotation making an angle with said engine axis; a swash plate mounted to said bearing means and being aligned with said plane of rotation with its own plane tilted relative to said engine axis; a connecting rod respective to each piston, said rod having a pair of ends; first pivot means connecting one said end of each of said rods to said swash plate; and second pivot means connecting the other said end of each of said rods to a respective piston, said exhaust ports opening upon a generally circular surface, in which said rotary valve is principally bounded by a generally circular surface, said surfaces being coaxial, and spaced from one another in close proximity, each of said exhaust ports being partially occluded by an axially-extending exhaust port web which serves to support a sliding piston ring as it moves along the exhaust port, there being a coolant passage extending through said exhaust port web through which coolant flows to cool said web.

5. A two-cycle engine according to claim 4 in which said coolant pump is mounted to said output shaft, coaxially therewith.

6. A two-cycle engine according to claim 5 in which at least one of said pivot means on each of said connecting rods is a clevis and pin combination.

7. A two-cycle engine according to claim 6 in which at least one of said pivot means on a plurality of said connecting rods has the function of limited rotation around the axis of the respective connecting rod, whereby to de-couple the respective piston from twisting torques which torques would otherwise tend to cause rifling movement as a consequence of interaction of the swash plate and of the respective connecting rod.

* * * * *